United States Patent [19]

Karube et al.

[11] Patent Number: 4,883,375

[45] Date of Patent: Nov. 28, 1989

[54] PRINTING DEVICE

[75] Inventors: Yoshiyuki Karube, Aza-kuroishi; Yuji Kawahara, Nagoya, both of Japan

[73] Assignee: Brother Kogyo Kabushiki Kaisha, Nagoya, Japan

[21] Appl. No.: 338,390

[22] Filed: Apr. 12, 1989

Related U.S. Application Data

[63] Continuation of Ser. No. 911,024, Sep. 24, 1986, abandoned.

[30] Foreign Application Priority Data

Sep. 26, 1985 [JP] Japan ..... 60-214359

[51] Int. Cl.[4] ..... B41J 11/20; B41J 13/04

[52] U.S. Cl. ..... 400/55; 400/638; 400/639; 400/636.1; 400/356

[58] Field of Search ..... 400/55, 56, 59, 638, 400/639, 639.1, 639.2, 636.1, 356

[56] References Cited

U.S. PATENT DOCUMENTS

| | | | |
|---|---|---|---|
| 3,951,249 | 4/1976 | Neilas et al. | 400/53 X |
| 4,010,834 | 3/1977 | Linder | 400/56 |
| 4,023,662 | 5/1977 | Perucca | 400/59 X |
| 4,024,940 | 5/1977 | Hendrischk et al. | 400/56 |
| 4,341,477 | 7/1982 | Theiler | 400/639.1 X |
| 4,420,269 | 12/1983 | Ackermann et al. | 400/59 X |
| 4,611,939 | 9/1986 | Fujiwara | 400/636.3 X |
| 4,637,415 | 4/1987 | Kikuchi et al. | 400/59 |
| 4,676,675 | 6/1987 | Suzuki et al. | 400/59 X |

FOREIGN PATENT DOCUMENTS

| | | | |
|---|---|---|---|
| 38283 | 10/1981 | European Pat. Off. | 400/56 |
| 0101841 | 3/1984 | European Pat. Off. . | |
| 41228 | 3/1980 | Japan | 400/53 |
| 49587 | 3/1982 | Japan | 400/58 |
| 56284 | 4/1982 | Japan | 400/55 |
| 170779 | 10/1982 | Japan | 400/56 |
| 209166 | 11/1984 | Japan | 400/55 |
| 79981 | 5/1985 | Japan | 400/55 |
| 104363 | 6/1985 | Japan | 400/53 |
| 154869 | 7/1986 | Japan | 400/55 |
| 167589 | 7/1986 | Japan | 400/55 |
| 1014770 | 4/1983 | U.S.S.R. | 400/55 |
| 1192935 | 5/1970 | United Kingdom | 400/55 |
| 2008498 | 2/1979 | United Kingdom . | |
| 8201514 | 5/1982 | World Int. Prop. O. | 400/55 |

*Primary Examiner*—William Pieprz
*Assistant Examiner*—James R. McDaniel
*Attorney, Agent, or Firm*—Jones, Tullar & Cooper

[57] ABSTRACT

A guide shaft guides a print head, which moves along a print line of a platen to perform a printing operation. A rotating member and an eccentric cam member, having a toothed sector portion on its periphery, are mounted on the guide shaft. The guide shaft is guided on a frame by a bearing slot, so as to be movable toward and away from the platen. The eccentric cam member rotates as it is always spring-urged to engage a fixed engaging pin. As a result, the guide shaft moves in a direction transverse to its axis, thus changing a gap between the print head and the platen. As the eccentric cam member rotates in one direction, the print head moves away from the platen, in a retreat stroke. In a rear half of the retreat stroke, the toothed sector portion of the rotating member engages a toothed arm, which is connected to a paper bail member for holding a printing medium down on the platen. Thus, as the gap between the print head and the platen is widened, the paper bail member moves from a medium hold position and a release position off the platen.

8 Claims, 4 Drawing Sheets

PRINTING DEVICE

This is a continuation of co-pending application Ser. No. 06/911,024, filed on Sept. 24, 1986, now abandoned.

BACKGROUND OF THE INVENTION

The present-invention relates to printing devices, such as typewriters, printers, data input/output devices, etc., having a print head which moves along a print line of a platen, for printing operation.

Conventional printing devices of this type are generally provided with a paper bail mechanism, which serves to securely hold printing media, such as printing paper, on a platen, lest the media be dislocated during the printing operation. This mechanism is designed so as to be movable between a hold position, where it presses the printing media against the platen, and a release position, where it is separated from the platen in releasing the media from the platen or setting the paper on the platen.

Meanwhile, the print head is located very close to the platen, during the printing operation, facing the platen with a fine gap therebetween, such that a proper printing pressure is applied to the printing media on the platen.

Since the gap is very narrow, however, the leading end of the printing media to be fed onto the platen will possibly be caught by the print head, thus failing to be passed smoothly through the gap. If the printing media are highly rigid or large in number, in particular, such a situation is a serious problem.

Thereupon, in order to settle the problem, a printing device has been proposed in which the print head can previously be moved to a position at a sufficient distance from the platen, by operating a setting lever, before the feed of the printing media onto the platen.

According to the proposed arrangement, however, the setting lever and the paper bail must be moved individually, each time the printing media are to be set on the platen, thus requiring complicated operation. Moreover, a moving mechanism for the print head, including the setting lever, and a gap adjusting mechanism for setting the printing pressure are provided independently. Also requiring a linking mechanism between the moving and adjusting mechanisms, therefore, the printing device is complicated in construction.

SUMMARY OF THE INVENTION

The object of the present invention is to provide a printing device of a simple construction, which can feed printing media quickly and securely onto a platen, and which facilitates automation of a series of operations before the start of printing operation.

In order to achieve the above object, a printing device according to the present invention comprises drive means for alternatively driving a print head in an advancing or retreating direction so that the print head moves toward or away from the platen, thereby changing the width of a gap between the print head and the platen, medium holding means movable between a hold position, where the holding means holds a printing medium down on the platen, and a release position, where the holding means is off the platen, and an operative-transmission means disposed between the drive means and the medium holding means. In this arrangement, the medium holding means is moved from the hold position to the release position, during a stroke for the retreat of the print head, by the drive means.

The drive means and the medium holding means are linked together by the operative-transmission means, thus obviating the necessity of several independent operations, and improving the operating efficiency.

In a preferred specific arrangement, the retreat stroke of the drive means includes a first stroke portion in the initial stage of the stroke, and a second stroke portion subsequent thereto. In the first stroke portion, the operation of the operative-transmission means is disabled. The operation is enabled only when the second stroke portion is reached.

In normal gap adjustment, for setting the printing pressure of the print head, the print head can move freely in the first stroke portion, independently of the medium holding means. In feeding the printing medium or media, on the other hand, the printing head and the medium holding means are linked. As a result, the individual operations of these elements are associated organically, thus facilitating automation of a series of preliminary operations before the start of the printing operation. Also, redundant use of mechanisms can be avoided, for simplicity of construction.

In a further preferred arrangement, a guide shaft, used to guide the print head along a print line of the platen, is allowed to move parallel to the platen, in a direction transverse to the print line. As an eccentric cam member, mounted on the guide shaft, rotates in cooperation with fixed engaging means, the guide shaft moves in the transverse direction, thereby changing the width of a gap between the print head and the platen. On the other hand, a rotating member, having a toothed sector portion, is mounted on the guide shaft, and rotates in a body with the eccentric cam member. When the eccentric cam member is in a first-half stroke portion of its retreat stroke, corresponding to the retreat of the print head, the toothed sector portion cannot engage a toothed arm, which rocks in a body with a paper bail arm. Only when a second-half stroke portion of the retreat stroke is reached, the sector portion engages the toothed arm, thereby causing the paper bail arm to rock to the release position.

According to the arrangement described above, the drive means and the operative-transmission means are simple in construction, easy to manufacture, and low in manufacturing cost.

DETAILED DESCRIPTION OF THE PREFERRED EMBODIMENT

Figure 1:
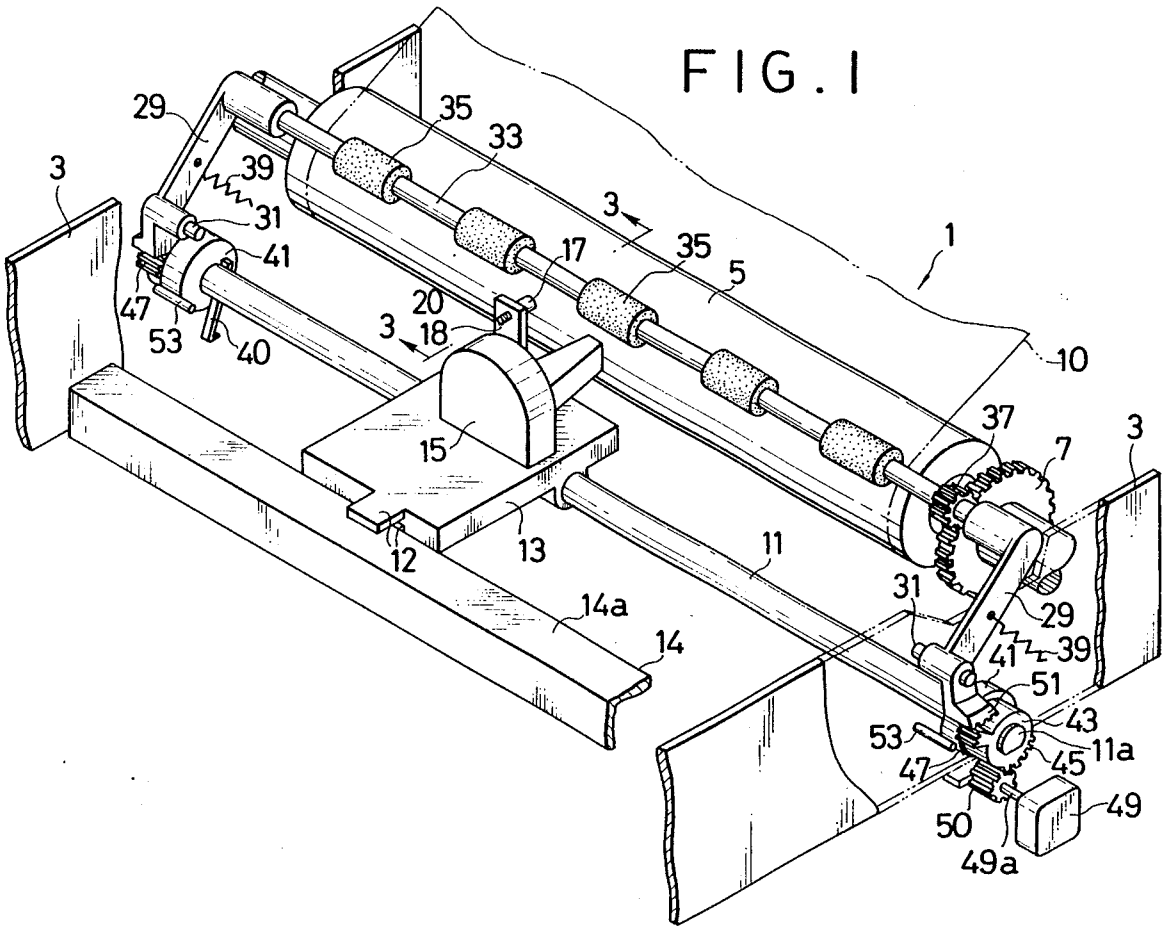
FIG. 1 is a partially broken perspective view of a printing device according to the present invention, with its cover removed.
Figure 2:
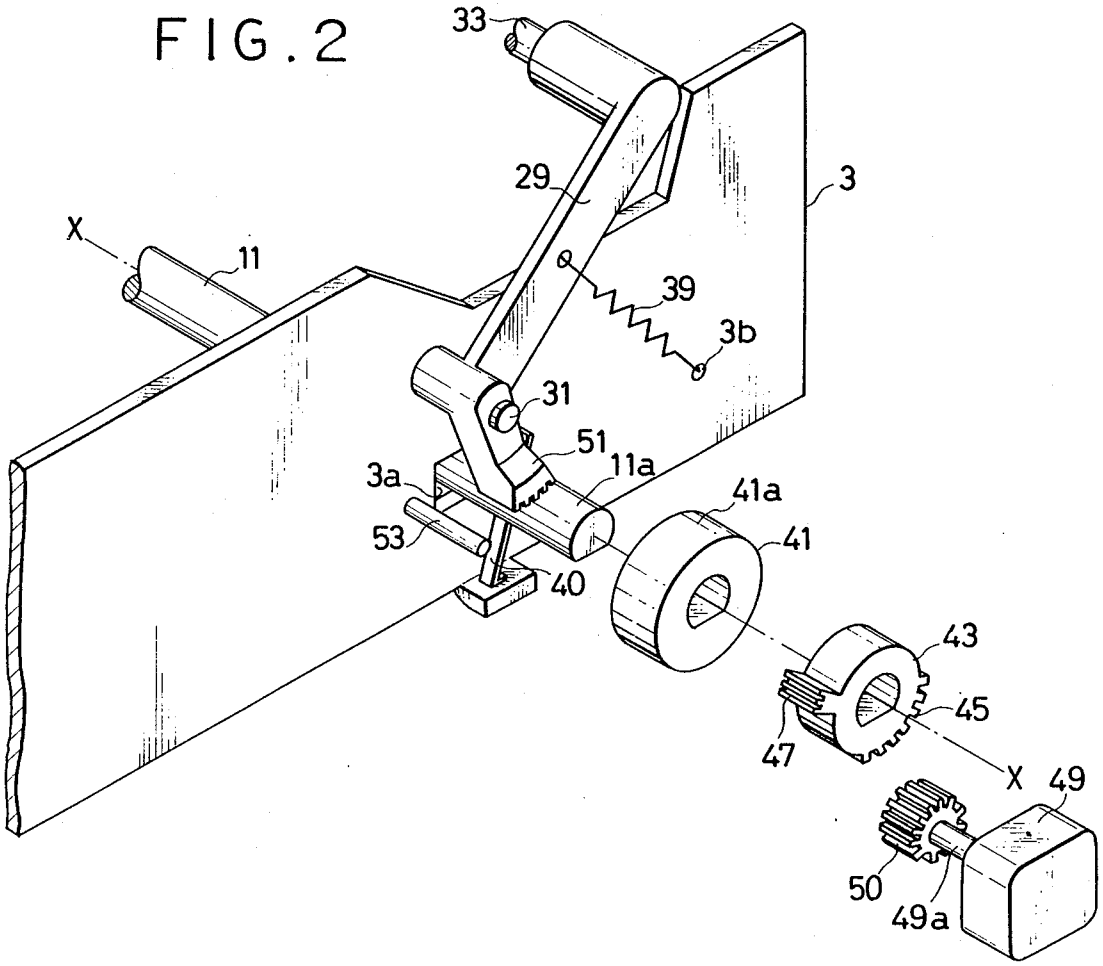
FIG. 2 is an enlarged, exploded perspective view showing the principal part of the device of FIG. 1.
Figure 3:
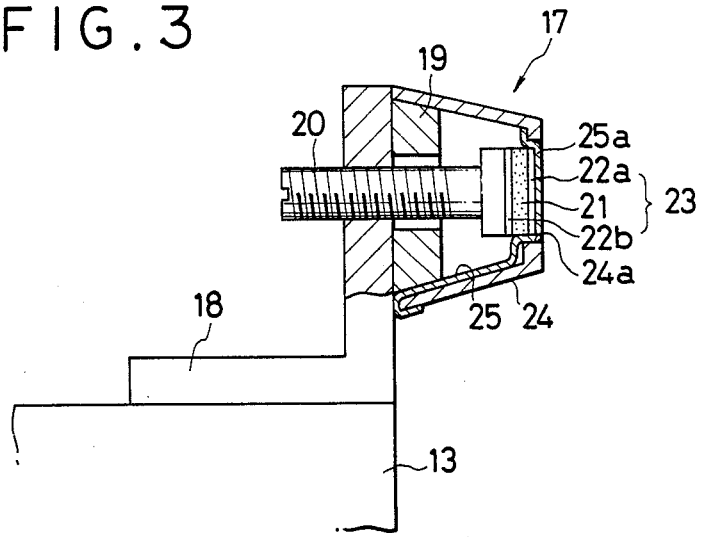
FIG. 3 is an enlarged, vertical sectional view of a paper-thickness sensor mechanism, as taken along line 3—3 of FIG. 1.

Referring now to FIGS. 1, 2 and 3, the construction of a printer 1 of a dot-impact type, as a printing device according to the present invention, will be described. As shown in FIG. 1, a platen 5 is rotatably supported between a pair of frames 3 (only a right-hand one shown in FIG. 2). The platen 5 is coupled with a platen drive motor (not shown), such as a stepping motor or DC motor. As the drive motor is driven, the platen 5 rotates in a predetermined direction. A driving gear 7 is attached to the right-hand side (FIG. 1) of the platen 5.

Each frame 3 is formed with a bearing slot 3*a* (FIG. 2), as bearing means, elongated in the transverse direction of the printer 1 or in the longitudinal direction of the frame 3. A guide shaft 11 is supported by the respective bearing slots 3*a* of the frames 3, so as to be rotatable parallel to the axis of the platen 5 and movable in the transverse direction perpendicular to an axis X-X (FIG. 2). The guide shaft 11 is located relatively to the bearing slots 3*a* by eccentric cam members 41, fixed pins 53, and leaf springs 40, which will be described in detail later. A carriage 13 is fitted on the guide shaft 11 so as to be slidable along the axis X-X of the shaft 11. Upper and lower lugs 12, facing each other at a predetermined distance, protrude from the front end face of the carriage 13. A top edge 14*a* of a guide rail 14, fixed between the frames 3, is loosely held between the lugs 12. Thus, the carriage 13 is supported by the guide shaft 11 and the guide rail 14, so as to be movable along the axis X-X of the shaft 11, and so that it can move also in the transverse direction of the printer 1 as the guide shaft 11 moves in the transverse direction perpendicular to the axis X-X. The carriage 13 is coupled with a carriage drive motor (not shown), such as a DC motor or stepping motor. As the drive motor is driven, the carriage 13 moves parallel to a print line of the platen 5. A print head 15 is mounted on the carriage 13. As it moves along the print line, the print head 15 prints on a printing medium 10, such as printing paper, on the platen 5, using print data in the form of a dot-matrix. In moving the print head 15, a number of electromagnets, contained in the head 15, are driven selectively in accordance with the print data, so that print wires corresponding to the electromagnets are operated. The print head 15 itself has a conventional construction.

A paper-thickness sensor 17 is mounted on the carriage 13 by means of a bracket 18. As shown in FIG. 3, a block 19 is fixed to the platen-side face of an upright portion of the bracket 18. An adjustment screw 20 is screwed in the upright portion of the bracket 18, so as to penetrate the block 19. A sensing element 23 is attached to the tip end of the adjustment screw 20. The sensing element 23 includes a sensor body 21 and a pair of electrodes 22*a* and 22*b*, between which the body 21 is sandwiched. The sensor body 21 is formed of pressure-sensitive conductive rubber, whose electric resistance varies gradually, depending on external pressure. A cap cover 24 is attached to the block 19 so as to cover the sensing element 23. An opening 24*a* is formed in the front end face of the cover 24 so that the sensing element 23 can be exposed toward the platen 5. A leaf spring 25 is fixedly held between the block 19 and the bottom portion of the basal end of the cover 24. A distal bent portion 25*a* of the leaf spring 25 is fitted on the outside electrode 22*a*. The outer surface of the bent portion 25*a* projects slightly from the opening 24*a* toward the platen 5, so as to be located between the platen 5 and the printing surface of the print head 15. Thus, the distance between the bent portion 25*a* and the surface of the printing paper 10 on the platen 5 is narrower than that between the printing surface of the head 15 and paper surface.

A pair of paper bail arms 29 are supported individually on the paired frames 3, so as to be rockable around their corresponding shaft pins 31, fixed to the frames 3. A paper bail shaft 33 is rotatably mounted on the respective free ends of the paper bail arms 29. A number of bail rollers 35 are fitted on the shaft 33, at predetermined intervals in the axial direction of the shaft 33. The paper bail arm 29, shaft 33, and bail rollers 35 constitute medium holding means for holding the printing medium 10 down on the platen 5. A driven gear 37 is mounted on the right end portion of the shaft 33, so as to be in mesh with the driving gear 7. Thus, when the paper bail arms 29 rock to their hold position, where bail rollers 35 abut against the platen 5, the driving and driven gears 7 and 37 engage each other. As the platen 5 rotates, therefore, the bail rollers 35 are rotated in the direction opposite to the rotating direction of the platen 5. As a result, the printing medium 10 is fed in close contact with the peripheral surface of the platen 5. One end of a tension spring 39, as an urging member, is anchored to an anchor hole 3*b* (FIG. 2) in each frame 3. The other end of the spring 39 is anchored to each corresponding paper bail arm 29. The tension springs 39 continually urge the paper bail arms 29 to rock toward the hold position, where the bail rollers 35 abut against the platen 5.

Each of the leaf springs 40 is in sliding contact with the peripheral surface of each corresponding shaft end portion 11*a* of the guide shaft 11, which projects outward from its corresponding frame 3. The proximal end portion of the leaf spring 40 is fixed to the frame 3. The leaf springs 40 resiliently urge the guide shaft 11 to move back so that the print head 15 retracts from the platen 5. The eccentric cam members 41 and rotating members 43 are fixed to their corresponding shaft end portions 11*a* of the guide shaft 11. As seen from FIG. 2, the members 41 and 43 are fitted on each shaft end portion 11*a* in a nonrotatable manner, and are adapted to rotate together with the shaft 11. Each of the fixed pins 53, fixed to the frames 3, is in sliding contact with a cam surface 41*a* of each corresponding eccentric cam member 41, urged by the leaf spring 40. Thus, when the eccentric cam member 41 is rotated by a stepping motor 49 (mentioned later), the guide shaft 11 moves in the transverse direction, that is, toward or away from the platen 5, depending on the gradual change of distance between the engaging point of the cam surface 41*a* and the rocking center of the cam member 41.

Figure 4:
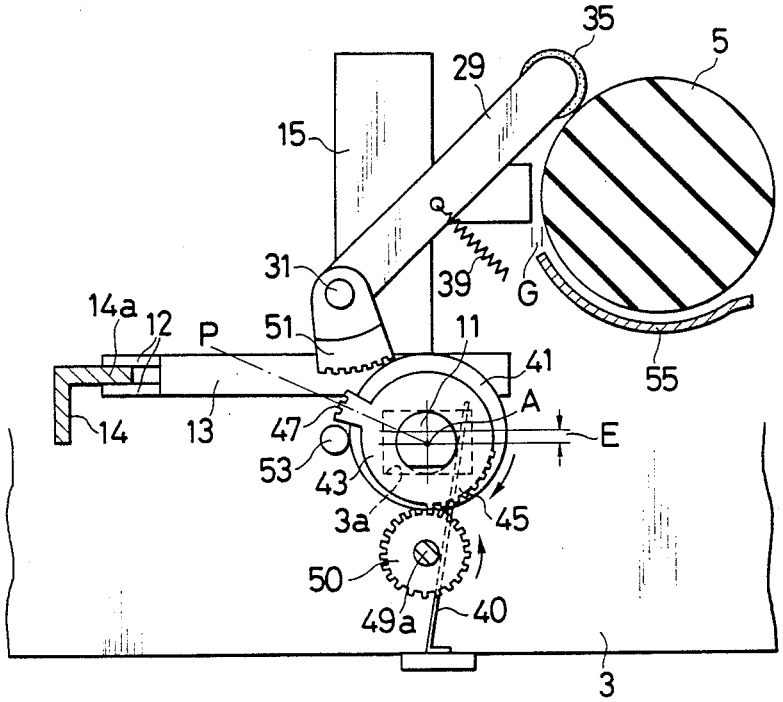
FIG. 4 is a right-hand side view, partially in section, showing mechanisms for moving a print head and a paper bail member.

As shown in FIG. 4, the eccentric cam member 41 has an eccentricity E to an axis point A of the guide shaft 11. Within a range of rotation of about 90 degrees, in the clockwise direction from the original position shown in FIG. 4, the distance between the point A and the engaging point of the cam surface 41*a*, in contact with the fixed pin 53, reduces gradually.

The rotating member 43 on the right end portion (FIG. 1) of the guide shaft 11 is formed, on its periphery, with driving teeth 45 and a toothed sector portion 47, which constitutes part of operative-transmission means. That rotating member 43 on the left end portion is formed with a toothed sector portion 47 only. The driving teeth 45 of the right-hand rotating member 43 is coupled with the reversible stepping motor 49, by means of a motor shaft 49*a* and a driving gear 50 fixed thereon. The stepping motor 49 is fixed to right-hand frame 3. As the motor 49 is driven, the guide shaft 11 rotates in the clockwise or counterclockwise direction. When the guide shaft 11 is rocked through a predetermined angle or more, by the motor 49, the toothed sector portion 47 of each rotating member 43, on each end of the shaft 11, engages a toothed arm 51, which is formed on the proximal end portion of each paper bail arm 29. The toothed arms 51 constitute part of the operative-transmission means. A photocoupler (not shown), as position detecting means, is provided at a region corresponding to a release position of the paper bail arms 29. In response to a detection signal from the photocoupler, the drive of the stepping motor 49 is interrupted.

Figure 5:
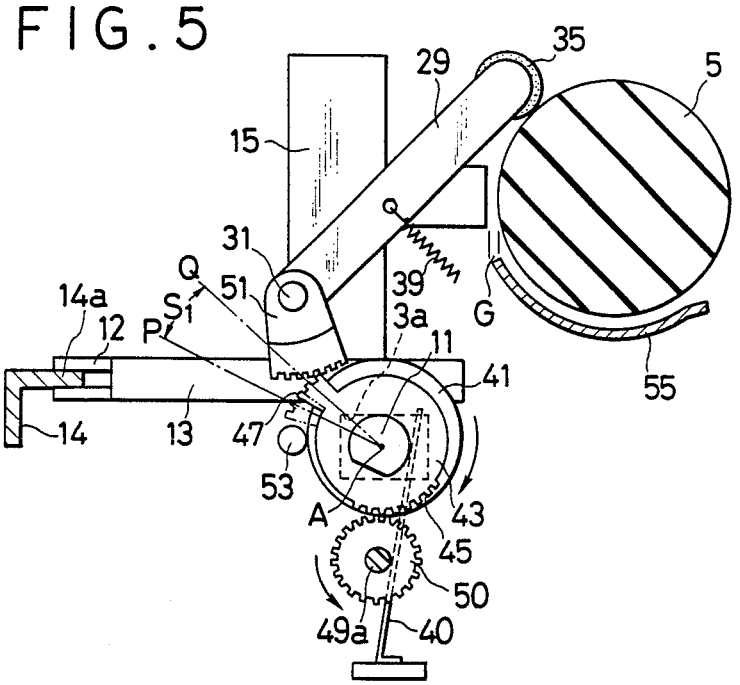
FIGS. 5 and 6 are side views, similar to FIG. 4, illustrating different operating states. An embodiment of the present invention will now be described in detail with reference to the accompanying drawings.
Figure 6:
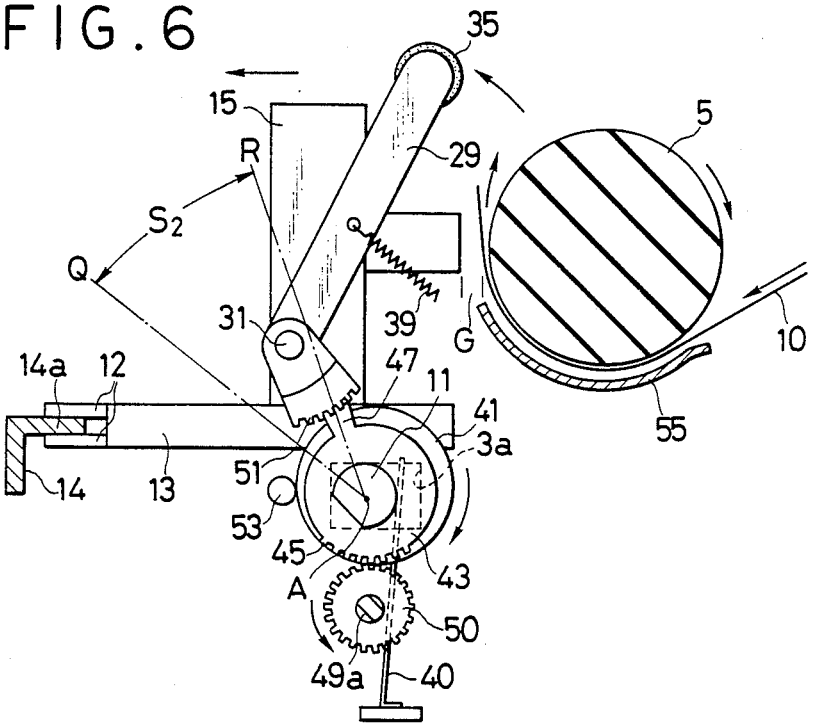

Referring now to FIGS. 4, 5 and 6, the operation of the printer 1 with the aforementioned construction will be described. In this embodiment, an initial pressure, corresponding to a necessary electric resistance, is applied to the sensor body 21, which is held between the tip end of the adjustment screw 20 and the distal bent portion 25*a* of the leaf spring 25, as shown in FIG. 3, as the screw 20 is turned.

FIGS. 4 to 6 show different positions of the guide shaft 11 and the paper bail arm 29, which depend on the position of the eccentric cam member 41. FIG. 4 shows a nonoperative state before the printing paper is wound on the platen 5. In this state, the paper bail arm 29 is in the hold position where the rollers 35 are in contact with the platen 5. Numeral 55 designates a conventional paper guide plate, which serves to guide the printing paper, along the platen 5, from under the platen 5 to the print side where the print head 15 is located.

When the stepping motor 49 is driven in one direction to rotate the driving gear 50 in the counterclockwise direction of FIG. 4, for paper supply to the platen 5, the driving force of the gear 50 rotates the rotating member 43 in the clockwise direction, through the medium of the driving teeth 45, so that the guide shaft 11 also rotates in the same direction. As a result, the eccentric cam member 41, at each shaft end portion 11*a* of the guide shaft 11, rotates together with the aforesaid members, in the clockwise direction of FIG. 4. As the cam member 41 rotates in this manner, the distance between its center and the fixed pin 53, in sliding contact with the cam surface 41*a*, reduces gradually. While rotating in the clockwise direction, therefore, the guide shaft 11 is moved to the left by the urging force of the leaf spring 40, guided by the bearing slot 3*a*. Thus, the print head 15 is moved backward or away from the platen 5. When the guide shaft 11 rotates clockwise through a predetermined angle, as the stepping motor 49 is further driven, as shown in FIGS. 5 and 6, the toothed sector portion 47 of the rotating member 43 rocks over a stroke S1, from a position P of FIG. 4 to a position Q of FIG. 5, thereby engaging the toothed arm 51. As the guide shaft 11 rotates further, thereafter, the paper bail arm 29 rocks in the counterclockwise direction of FIG. 6, from the hold position of FIG. 5, around the shaft pin 31. As a result, the bail rollers 35 are moved, as indicated by an arrow in FIG. 6, to the release position, at a long distance from the platen 5. When the paper bail arm 29 is moved to the release position, the drive of the stepping motor 49 is interrupted in response to the detection signal from the photocoupler (not shown).

While the arm 29 is moving, the toothed sector portion 47 of the rotating member 43 rocks over the stroke S2, from the position Q to a position R. Thus, the eccentric cam 41 rotates through the same angle with the rotating member 43, that is, through an angle equivalent to the sum of the strokes S1 and S2. In the meantime, the print head 15 moves away from the platen 5, as indicated by an arrow in FIG. 6.

When the eccentric cam member 41 is in the stroke S1 at the start of its rotation for retreat, only a gap G between the print head 15 and the platen 5 changes. When the gap G changes in this manner, the paper bail arm 29 starts to rock only after the stroke S2 is entered. Thus, the stroke S1 is used in gap adjustment for the control of the printing pressure of the print head 15.

When the platen 5 is rotated clockwise, in the state shown in FIG. 6, the leading end of the printing paper 10, fed to the platen 5, is guided by the paper guide plate 55. Thereafter, the printing paper 10 passes freely between the printing surface of the print head 15 and the platen 5, spaced at a wide distance from each other, and is then fed upward to a predetermined paper-feed position, between the rollers 35 in the release position and the platen 5. In order to feed the leading end of the printing paper 10 accurately to the predetermined position, the platen drive motor is driven for a predetermined number of steps, after the leading end passes a paper detector (not shown), which is located near the printing position.

When the printing paper 10 is fed to the predetermined position in this manner, the stepping motor 49 is driven in reverse. Thereupon, the guide shaft 11, along with the eccentric cam member 41 and the rotating member 43, rotate in the counterclockwise direction, thereby returning the paper bail arm 29 from the release position to the hold position. When in the hold position, the arm 29 presses the printing paper 10, in the predetermined position, against the platen 5, urged by the resilient force of the tension spring 39. Meanwhile, the driving gear 7 engages the driven gear 37.

As the guide shaft 11 rotates in the counterclockwise direction, the distance between the center A of rotation of the eccentric cam member 41, and that portion of the cam surface 41*a* in sliding contact with the fixed pin 53, increases gradually. As a result, the guide shaft 11 is moved forward so that the print head 15 approaches the platen 5. In the initial range of the advance stroke, that is, in the stroke S2, the rollers 35 are first brought to the hold position. Then, in the range of the stroke S1, the toothed sector portion 47 is disengaged from the toothed arm 51, so that only the print head 15 is left continues to move and approaches the platen 5. In the final stage of the advance or forward movement of the print head 15, the outer surface of the distal bent portion 25*a* of the leaf spring 25 is pressed against the surface of the printing paper 10 on the platen 5. As the print head 15 approaches the printing paper 10, the electric resistance of the sensor body 21 lowers gradually. When the resistance of the sensor body 21 varies from a value corresponding to the initial pressure to a predetermined reference resistance value, corresponding to the number or thickness of printing sheet(s) on the platen 5, the drive of the stepping motor 49 is interrupted to stop the print head 15. Thereafter, the motor 49 is reversely rotated in reverse again so that a narrow gap is formed between the sensing end face of the sensor body 21 and the printing paper 10. Thus, the gap G between the printing surface of the print head 15 and the surface of the printing paper 10, on the platen 5, is adjusted so as to provide the desired printing pressure.

While the print head 15, in this state, is being moved along the print line, the electromagnets in the printing head 15 are driven selectively in accordance with the print data, so that the print data is printed as a dot-matrix.

Thus, according to this embodiment, the stepping motor 49 is driven in one direction, in setting the printing paper 10 in place in the printer 1. By doing this, the print head 15 moves back or away from the platen 5, assisted by the cooperation of the rotating eccentric cam member 41 and the fixed pin 53, so that a gap, wide enough to permit a free passage of the printing paper 10, is formed between the printing surface of the print head 15 and the platen 5. In the second-half stroke S2 of the retreat stroke, moreover, the paper bail arms 29 are rocked from the hold position to the release position. In this manner, the leading end portion of the printing paper, transported with the rotation of the platen 5, is prevented positively from coming into contact with the print head 15. Thus, the printing paper can be fed securely.

The driving gear 50, driven teeth 45, toothed sector portion 47, and toothed arm 51 have tooth configurations such that their engagement can be maintained if the rotating member 41 moves together with the guide shaft 11.

The pressure setting gap G between the print head 15 and the platen 5 can be adjusted within the range of the stroke S1. In this range, the toothed sector portion 47 of the rotating member 41 and the toothed arm 51 are not in engagement, and the operation of the paper bail 29 is disabled, thus permitting a free gap adjustment for the setting of the printing pressure.

In the embodiment described above, the guide shaft 11 is moved together with the eccentric cam member 41, for the movement of the print head 15 transverse to the platen 5. Alternatively, however, the guide shaft may be allowed only to rotate so that the print head moves transversely with the rotation of the guide shaft, assisted by eccentric cam means disposed between the shaft and the carriage.

Further, the operative-transmission means, including the toothed sector portion 47 and the toothed arm 51, according to the above embodiment, may be replaced with levers which extend individually from the rotating member and the paper bail arm, and can engage each other.

It is to be understood that the present invention is not limited to the arrangements of the above described embodiments.

What is claimed is:

1. In a printing device including a frame, a platen wound, on its peripheral surface, with a printing medium, a print head which defines a gap between the print head the the platen and is movable parallel to the platen, along a print line of the platen, so that the printing medium is printed as the print head moves, and medium holding means movable between a hold position in which the holding means holds the printing medium down on the platen, and a release position in which the holding means is off the platen, said printing device comprising:

drive means for moving the print head back and forth in a transverse direction, with respect to the print line of the platen, said drive means having an advance stroke, in which the print head is moved toward the platen, and retreat stroke, in which the print head is moved away from the platen; and operative-transmission means operative for operatively connecting the drive means and the medium holding means so that the medium holding means is moved from the hold position to the release position, wherein:

said retreat stroke of said drive means including, at the start of the retreat stroke, a first stroke portion in which operation of said operative-transmission means is disabled and, subsequent to the first stroke portion, a second stroke portion in which operation of said operative-transmission means is enabled;

said first stroke portion being allowed to an adjustment operation of said gap for regulating printing condition by said print head on the printing medium, thereby causing said adjustment operation of said gap to be done independently of the operation of said operative-transmission means;

said drive means includes a single reversible electric motor, adapted to provide the advance stroke by rotating in one direction, and to provide the retreat stroke by rotating in the other direction, said motor being stopped at the end position of the advance stroke and then rotating reversely, thus starting the first stroke portion of the retreat stroke; and said gap adjustment operation being continued during said first stroke portion until said gap has a predetermined width.

2. The printing device according to claim 1, characterized by further comprising position detecting means for delivering a position detection signal to the electric motor to stop the same, thereby defining the end position of the retreat stroke, when the medium holding means reaches the release position, in the retreat stroke.

3. The printing device according to claim 1, wherein said drive means includes a guide shaft disposed parallel to the platen in order to guide the print head in movement along the print line, support means provided on the frame supporting the guide shaft, and an eccentric cam member rotatable around the axis of the guide shaft.

4. The printing device according to claim 3, further wherein:

said operative-transmission means includes a rotating member rotatable around the axis of the guide shaft and having a toothed sector portion on the periphery thereof, and a toothed arm connected to the medium holding means, pivotally mounted on the frame, and capable of engaging the toothed sector portion, said toothed arm and said toothed sector portion engaging each other at a part of the retreat stroke, thereby moving the medium holding means from the hold position to the release position.

5. The printing device according to claim 4, further wherein said support means is formed of a bearing slot through which the guide shaft is passed parallel to the platen, so as to be movable only in the transverse direction, with respect to the print line, and said drive means further includes fixed engaging means mounted on the frame so as to engage the peripheral surface of the eccentric cam member, and urging means for urging the cam member always to engage the engaging means while the cam member is rotating, so that the guide shaft moves in the transverse direction, guided by the bearing slot, as the cam member rotates.

6. The printing device according to claim 5, further wherein said eccentric cam member and said rotating member are fixed to the guide shaft at one end portion thereof.

7. The printing device according to claim 6, further wherein said rotating member has driving teeth on the periphery thereof, said printing device further comprising a driving gear engaging the driving teeth of the rotating member, so that the driving gear is reversibly rotated around a fixed axis by said reversible motor, said driving gear being capable of maintaining the engagement with the rotating member, while allowing the rotating member, along the guide shaft, to move in the transverse direction with respect to the print line of the platen.

8. The printing device according to claim 1, which further comprises: medium thickness sensing means which can be moved together with the print head, in the transverse direction, with respect to the print line of the platen, by the drive means, keeping a fixed positional relation with the print head, said medium thickness sensing means coming into contact with the printing medium on the platen, in the advance stroke of the drive means, and delivering a detection signal, and, further wherein:

said motor is stopped in response to the detection signal delivered from the medium thickness sensing means.

* * * * *